US005656000A

United States Patent [19]

Russell

[11] Patent Number: 5,656,000

[45] Date of Patent: Aug. 12, 1997

[54] EXERCISE APPARATUS

[76] Inventor: Brian A. Russell, 7869 S. Independence Way, Littleton, Colo. 80123

[21] Appl. No.: 454,582

[22] Filed: May 30, 1995

[51] Int. Cl.[6] ..... A63B 23/04

[52] U.S. Cl. ..... 482/52; 482/23; 482/74

[58] Field of Search ..... 482/52, 26, 51, 482/79, 23, 74; 297/452.55, 440.1

[56] References Cited

U.S. PATENT DOCUMENTS 5,414,884 5/1995 Mackenzie ..... 297/452.55

*Primary Examiner*—Lynne A. Reichard

*Attorney, Agent, or Firm*—Timothy J. Martin; Michael R. Henson

[57] ABSTRACT

An exercise device for exercising the user's legs includes a base member having a bottom for engaging a flat support surface and upwardly opening sockets defined by a bottom panel and an upright surrounding socket with cushion elements constructed of resilient compressible material. The cushion elements have lower portions sized and adapted to be nestably received within the sockets and upper portions forming a domical structure that projects above the base member when the cushion elements are received within the sockets.

29 Claims, 4 Drawing Sheets

EXERCISE APPARATUS

FIELD OF THE INVENTION

The present invention concerns apparatus to be used by a person in exercising his/her body. More particularly, the present invention relates to resistance-type exercise apparatus especially adapted for use in exercising a user's legs.

BACKGROUND OF THE INVENTION

The value of exercising the human body as an avenue to optimum health cannot be overly estimated. As a result of this awareness, more and more people are attempting to take the opportunity for exercise. Accordingly, many health clubs and other recreational facilities have been constructed and are attended by people seeking to stay physically fit. Sales of in-home exercise equipment has likewise escalated.

A vast array of mechanical apparatus has been developed for use in exercising the human body. One such type of apparatus typically includes a grip or engagement structure which a person engages, for example, with his/her arms, hands, back, feet, etc. The engagement structure is connected by cables, cams and pulleys to a weight assembly so that a selected weight may be loaded depending upon the individual's own strength. Other types of exercise machines includes treadmills, stationary bicycles, stair step machines and the like. While there is little doubt that these various exercising apparatus, if used properly, are of great utility in attaining and maintaining a physically fit body, such machines have two primary drawbacks. First, such apparatus are fairly complex in construction and are correspondingly expensive. Second, proper exercise requires a significant number of these machines to exercise the whole body.

Since few individuals can afford the complete ensemble of machines necessary to exercise the body, most individuals join health or recreational clubs which maintain an ensemble of machines for on-premise use. Unfortunately, the inconvenience of travel to a health club facility coupled with the cost of maintaining membership discourages many individuals from keeping up with their exercise regimen.

There has been recognized, therefore, a need for exercise apparatus that may be used in-home in addition to such equipment that may be available at health club and recreational facilities. Examples of common exercise apparatus of this type include treadmills, stair step machines and stationary bicycles. Another type of such apparatus is the resilient, compressible foam devices which I have disclosed in my earlier U.S. Pat. Nos. 4,253,661 and 4,603,851.

In each of my two earlier patents, I have disclosed leg exercising apparatus wherein a dense, resilient, compressible foam material is molded into a configuration that provides a ground engaging base with an upper surface which may be engaged by the feet of a user. Various exercises may be performed while standing or running in place on this device with the controlled compression and resilience of the foam providing beneficial resistance to the exercise. I have found that it is important to control the resistance to compression by the various pad portions of these devices in order to increase the performance thereof.

In order to control the compression of the foot pad portions of these devices, it is important that undesirable lateral spreading be eliminated and to isolate foot pads against potential transfer of energy from the compression of one foot pad to the other. My earlier exercise apparatus, as disclosed in the above referenced patents, had such disadvantages due to their unitary molded construction.

Moreover, as a result of the transfer of energy, shearing or tearing between the foot pads could occur which would destroy the usefulness of the entire apparatus.

Accordingly, despite the improvements and advantages of all of the exercise apparatus described above, there remains a need for improved exercise apparatus which are simple and durable in construction. There remains a need for improved apparatus which may be used by a person for in-home exercising at a reasonable cost. There is further a need for exercise apparatus which are compact and easily stored.

SUMMARY OF THE INVENTION

It is an object of the present invention is to provide a new and useful exercise apparatus which is simple in construction yet versatile in use.

Another object of the present invention is to provide an exercise apparatus which can be used in safely exercising the legs of the human body in a manner that simulates muscular activity encountered during sporting activities.

A further object of the present invention is to provide an exercise apparatus using a resilient, compressible medium which apparatus is configured so as to control compression and rebound of the medium while preventing over-pronation and over-supination of the ankle during use.

It is still a further object of the present invention to provide an exercise apparatus that is simple and inexpensive in manufacture and easy to maintain.

Yet another object of the present invention is to provide a compact exercise apparatus which requires limited space for use and storage.

Still a further object of the present invention is to provide an exercise apparatus that has a universal base which can accept different compressible elements so as to vary the performance of the exercise apparatus.

According to the present invention, then, an exercise apparatus is adapted to be supported on a flat support surface for use in exercising a user's legs. The exercise apparatus includes a base member and one or more cushion elements that are nestably received in the base member. More specifically, the base member includes a bottom for engaging the flat support surface and has an upwardly opening socket including an upright surrounding socket sidewall. The cushion element is constructed of a resilient, compressible material. The cushion element has a lower portion sized and adapted to nestably received in the socket so as to retain the cushion element in a mounted state with respect to the base member. The cushion element has an upper portion which forms a dome-like structure that projects above the base member when the cushion element is in the mounted state. The dome-like structure has a top surface that is operative to engage a foot of a user during use.

Preferably, the base member has an inner base wall that defines the socket sidewall and an upstanding outer base wall which defines a periphery for the base member. The inner base wall and outer base wall are upwardly convergent and are joined by a rim wall which forms an upper rim for the base member. A bottom panel extends across the lower portion of the base member and is adapted to rest on the flat support surface. This bottom panel is preferably interrupted by rib structure that separates the bottom panel into a pair of panel sections and forms a pair of sockets which are juxtaposed to one another and are elongate in one direction. The rib structure has a pair of upwardly converging, opposed rib walls which are joined by a top rib wall that is coextensive with the rim of the base member. Accordingly, then, a pair of independent cushion elements are preferably received in each of the sockets. The base member may also be constructed so as to orient the top surfaces of the pair of cushion elements at a large obtuse angle with respect to each other, with this angle preferably being at least 140°.

In order to stabilize the cushion elements in the base member, the lower and upper portions of each cushion elements are joined at a juncture that includes a shoulder which will engage both the rim wall of the sidewall that surrounds the respective socket and the top rib wall of the rib structure when the cushion element is nested in the base member. Furthermore, the rib walls and the inner base wall may be provided with recesses, and the lower portion of the cushion elements may be provided with key structures adapted to engage the recesses so as to further enhance the stability of the exercise apparatus.

A variety of different constructions of the cushion elements are possible. For example, in integral upper portion may be provided with a pair of lower portions which are nestably received in the pair of juxtaposed sockets so that the upper portion has a single uninterrupted top surface as opposed to the two dome-shaped structures provided by the two independent cushions. Furthermore, the cushion elements may be constructed of different materials laminated to one another or as inserts to change the performance characteristics of the exercise apparatus. The upper surface of the cushion elements may be crowned either longitudinally, laterally or both. If desired, the upper surface may be configured to oriented at an angle of 20° or less with respect to the flat support surface when in the mounted state. The upper surface may be also be provided with a skin laminated thereon, with this skin being constructed of neoprene, latex or similar material.

Optional elastic cords may be employed with the present invention with these cords being formed, for example, by rubber tubing. One such cords is disposed on each opposite side of the base member and each includes proximal end portions secured thereto. The cords are of sufficient length so that the user may grasp distal end portions thereof while standing on the top surface of the cushion element. Preferably, each of the elastic cords is formed as a loop having a pair of opposite ends fastened to the base member at spaced locations from one another, and several attachment points are provided so the location of attachment may be selectively varied. Each of the elastic cords then has a central loop that defines the distal end portion of the respective cord, and this central loop may be provided with an enlarged grip. A sleeve may be provided to adjust the angle between the end portions of the cords and to vary the effective length of the cord. This further allows customization of the performance of the exercise apparatus.

These and other objects of the present invention will become more readily appreciated and understood from a consideration of the following detailed description of the exemplary embodiment when taken together with the accompanying drawings, in which:

DETAILED DESCRIPTION OF THE EXEMPLARY EMBODIMENTS

The present invention broadly concerns exercise apparatus and particularly is directed to an exercise apparatus that is compact, portable and easy to store. The exercise apparatus according to the present invention utilizes the compressible resilient properties of foam materials as an aid in creating a device that may be used by a person to exercise his/her legs in an effective manner although other exercises may be performed on this apparatus. Broadly, the exercise apparatus of the present invention includes a universal base member that is adapted to be supported on a flat support surface, and at least one cushion element which is constructed to be mounted into the base. This cushion element is preferably constructed of a compressible resilient material of suitable durability to withstand repetitive motion of user's legs and feet thereon.

Figure 1:
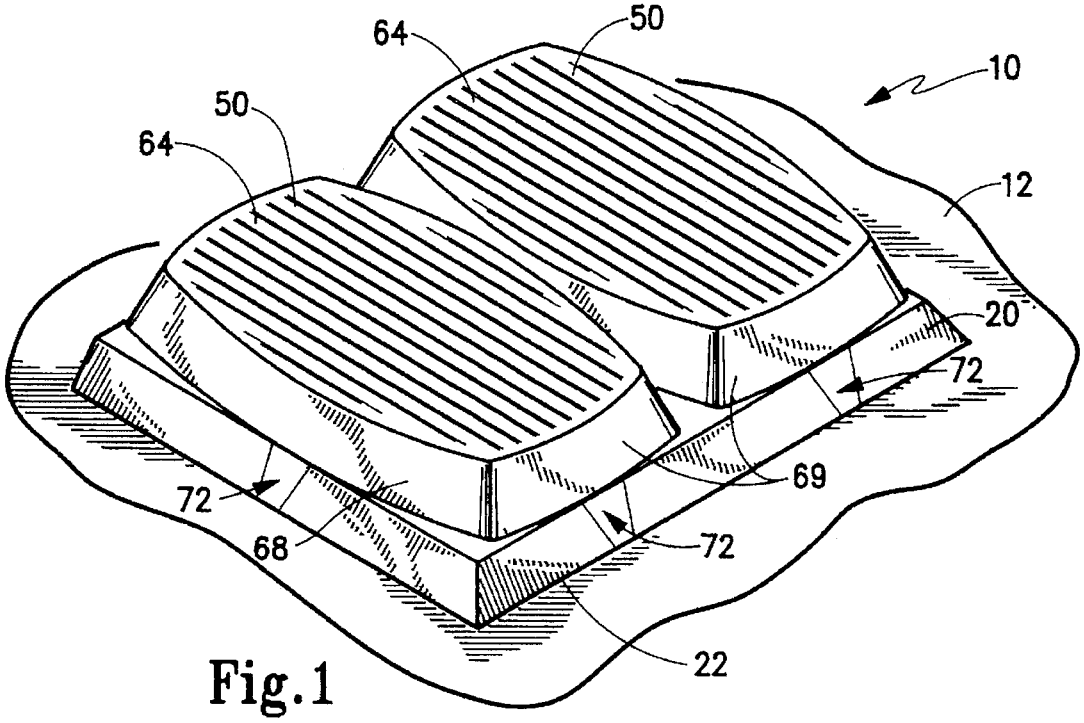
FIG. 1 is a perspective view of the exercising apparatus according to a first exemplary embodiment of the present invention.
Figure 2:
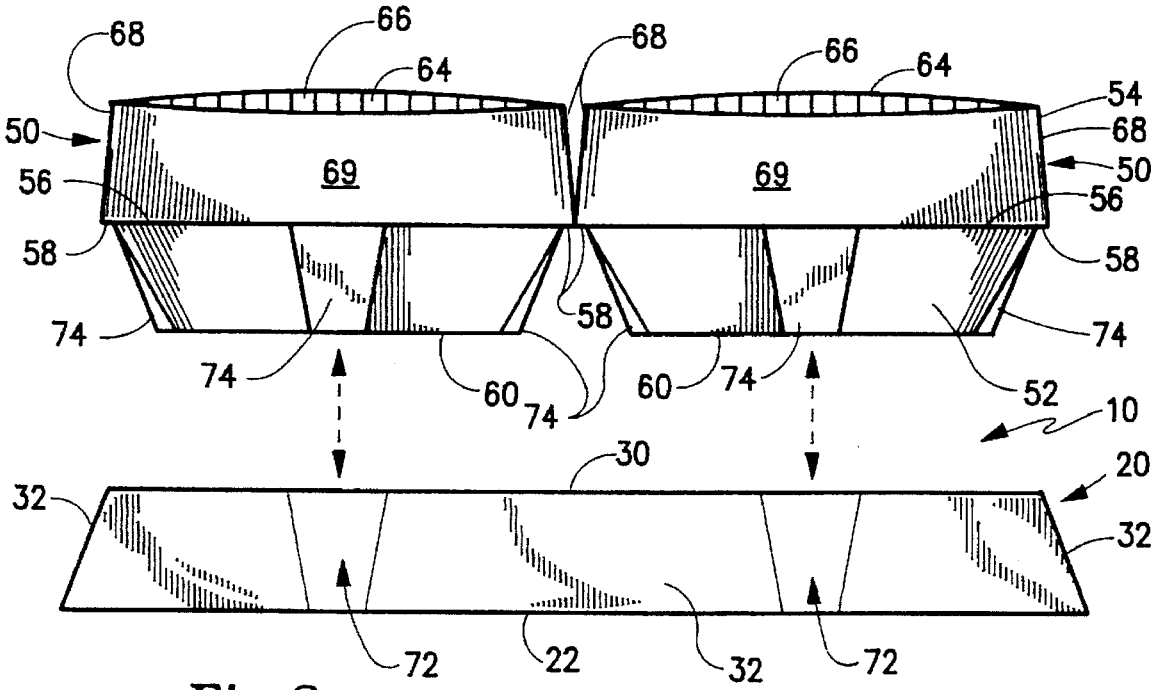
FIG. 2 is an exploded side view in elevation of the exercise apparatus shown in FIG. 1.

With reference to FIGS. 1 and 2, it may be seen that exercise apparatus 10 according to a first exemplary embodiment of the present invention is adapted to be supported on a flat support surface 12. Exercise apparatus 10 includes a base member 20 and a pair of cushion elements 50 each of which provide a surface 64 that may be engaged by the feet of the user. Base 20 includes a bottom in the form of a peripheral edge 22 which rests on the support surface.

The construction of base member 20 is best shown with references to FIGS. 1–4 wherein it may be seen that base member 20 is in the form of a tray or shell that is integrally molded as a unitary, one-piece construction of durable plastic material. Base member 20 includes a bottom panel formed as panel sections 24 and 26, and an upstanding inner base wall 28 extends upwardly from the other perimeters of panels 24 and 26 to terminate in an outwardly projecting flange or upper rim portion 30. An upstanding outer base wall 32 depends downwardly from upper rim portion 30 to terminate in bottom edge 22, best shown in FIG. 4. As may be seen in this figure, inner base wall 28 and outer base wall 32 are upwardly convergent toward rim portion 30 to form an inverted, V-shaped channel structure 31 that supports the outer periphery base member 20. Preferably inner base wall 28 is formed at an angle of between 120° and 130° respectively to panel sections 24 and 26.

Moreover, it may be seen that base member 20 includes a pair of upwardly opening elongated sockets 34 which are juxtaposed with respect to one another and which are separated by an upstanding rib structure 36 formed by a pair of upstanding rib walls 38 which extend from bottom panels 24, 26 to terminate in an upper rib wall 40 which is coextensive with upper rim portion 30. Rib walls 38 are opposed to one another and are upwardly convergent again at the preferred angle of 120° and 130° with respect to panel sections 24 and 26. Thus, each of sockets 24 have a surrounding sidewall formed by one of the opposed rib sidewalls 38 and a portion of upstanding inner base wall 28; this surrounding sidewall is therefor upwardly divergent.

Each of sockets 34 nestably receives a foot pad or cushion element 50, with cushion elements 50 being best shown in FIGS. 1, 2 and 5–7. Cushion elements 50 are molded of expanded urethane foam, and it may here be seen that each cushion element 50 is elongate and includes a lower portion 52 and an upper portion 54 joined with one another at a juncture 56 that occurs at the demold location. Upper portion 54 has a dimension slightly larger than lower portion 52 to create a shoulder 58 at juncture 56. Lower portion 52 is sized and adapted to nestably mate in each of sockets 34. Accordingly, lower portion 52 has a bottom surface 60 and an upwardly divergent sidewall 62 which extends from bottom surface 60 to terminate at juncture 56. The angle of divergence of sidewall 62 is identical to the divergence of inner base walls 28 and rib walls 38, described above, and this preferred angle is between 120° and 130°. Thus, bottom surface 60 will engage a respective bottom panel section 24, 26 while sides 62 will engage inner base walls 28 and rib walls 38. Furthermore, it should be understood that lower base portion 52 has a sufficient height so that shoulder 58 will rest on the upper rim portion 32 and upper rib wall 40 further stabilizing cushion element 50 in a respective socket 34. Upper portion 54 of cushion element 50 has a top surface 64 which is adapted to engage the foot of the user, and a ribbed tread surface 66 may be molded or laminated onto upper surface 64, if desired. Upper portion 54 has a surrounding sidewall formed by elongate sidewalls 68 and endwalls 69. This sidewall is shown to be slightly upwardly convergent to top surface 64. Sidewalls 68 and 69 meet at corners 70. If desired, these sidewalls 68 and endwalls 69 may be formed with a pebbled texture.

Figure 3:
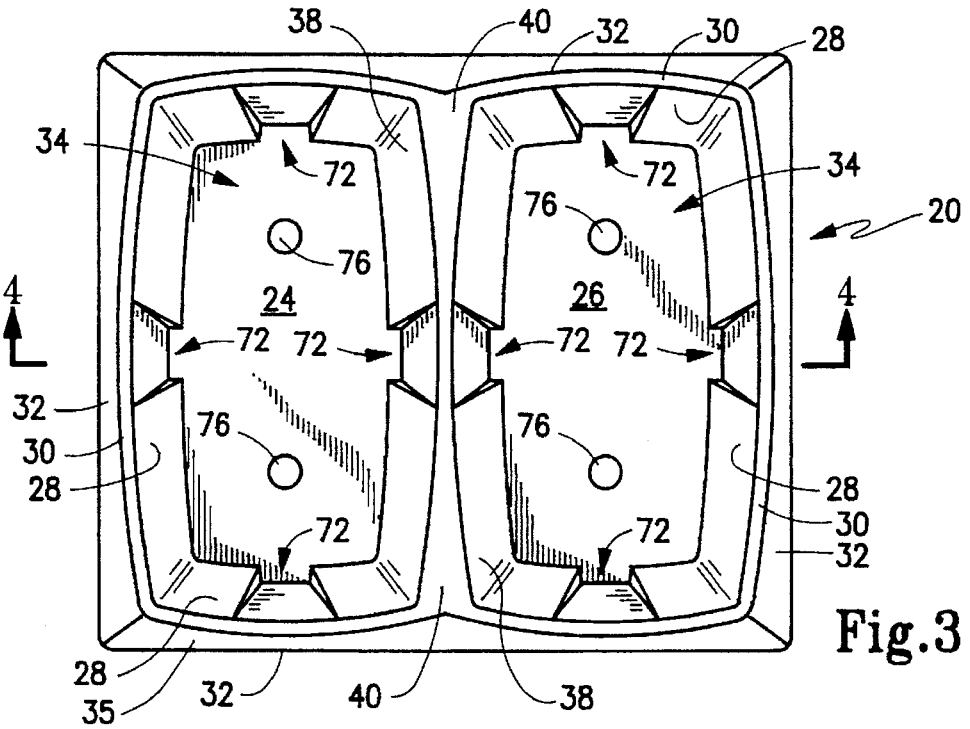
FIG. 3 is a top plan view of the base member of the exercise apparatus shown in FIGS. 1–2.
Figure 4:
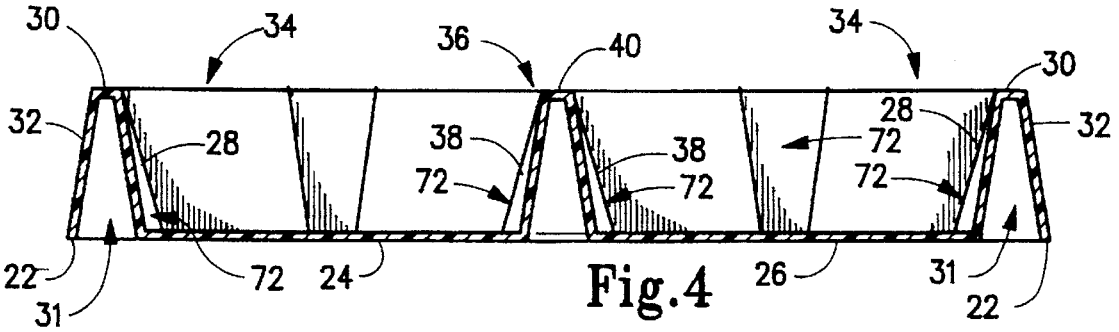
FIG. 4 is a cross-sectional view taken about lines 4—4 of FIG. 3.
Figure 5:
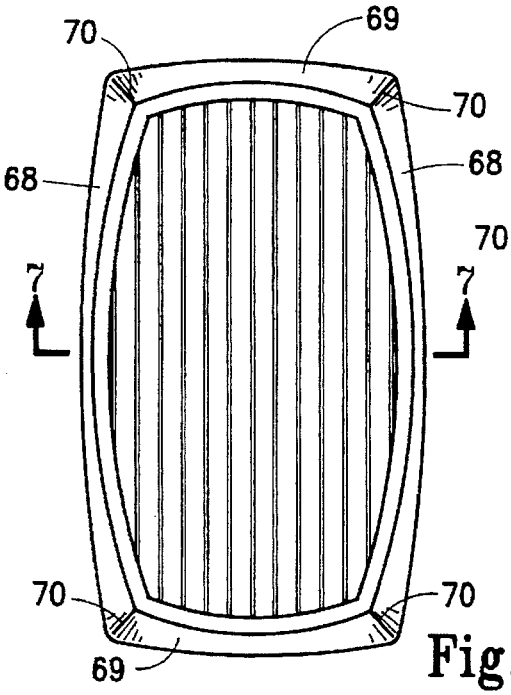
FIG. 5 is a top plan view of a cushion element used with the exercise apparatus shown in FIGS. 1–2.
Figure 6:
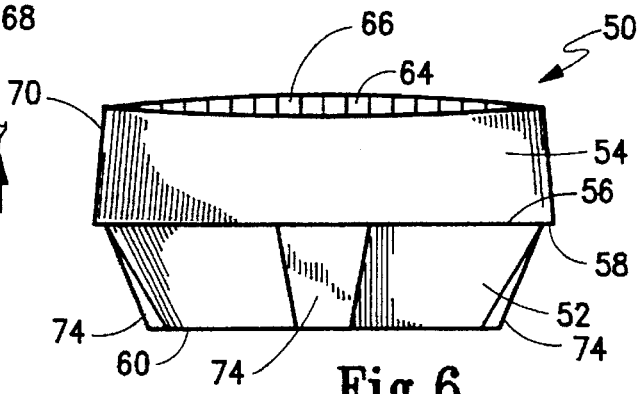
FIG. 6 is an end view in elevation of the cushion element shown in FIG. 5.
Figure 7:
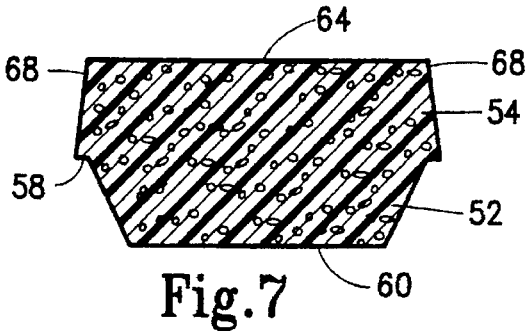
FIG. 7 is a cross-sectional view taken about lines 7—7 of FIG. 5.

As noted, a pair of cushion elements 50 are nestably received in sockets 34 of base member 20, and it is important that each of cushion elements 50 be stable during use. To increase the stability, the surrounding sidewall of each socket 34, that is, inner base walls 28 and rib walls 38 are provided with a plurality of wedge-shaped recesses 72. Correspondingly, lower portions 52 of cushion element 50 have a plurality of key structures 74 spaced therearound and oriented so as to securely engage recesses 72 when lower portions 52 are nestable received in sockets 34. As noted above, when this occurs, shoulders 58 securely rest on rim portions 30 and upper rim wall 40 to releasably support each cushion element 50 in a stable manner. In addition, as is shown in FIG. 3, each of bottom panels 24 and 26 includes a pair of openings 76 which allows the escape of any air which might otherwise become entrapped between cushion element 50 and the respective panel section 24, 26 during use. These openings 74 also allow a small protrusion of the cushion material to intrude into the opening thereby further stabilizing cushion elements 50 during use. Finally, by formed corners 70 at the intersections of sidewalls 68 and 69, further stability results since these corners resist rotation about a central axis that is perpendicular to the support surface 12 when cushion elements 50 are in the mounted state.

Figure 8:
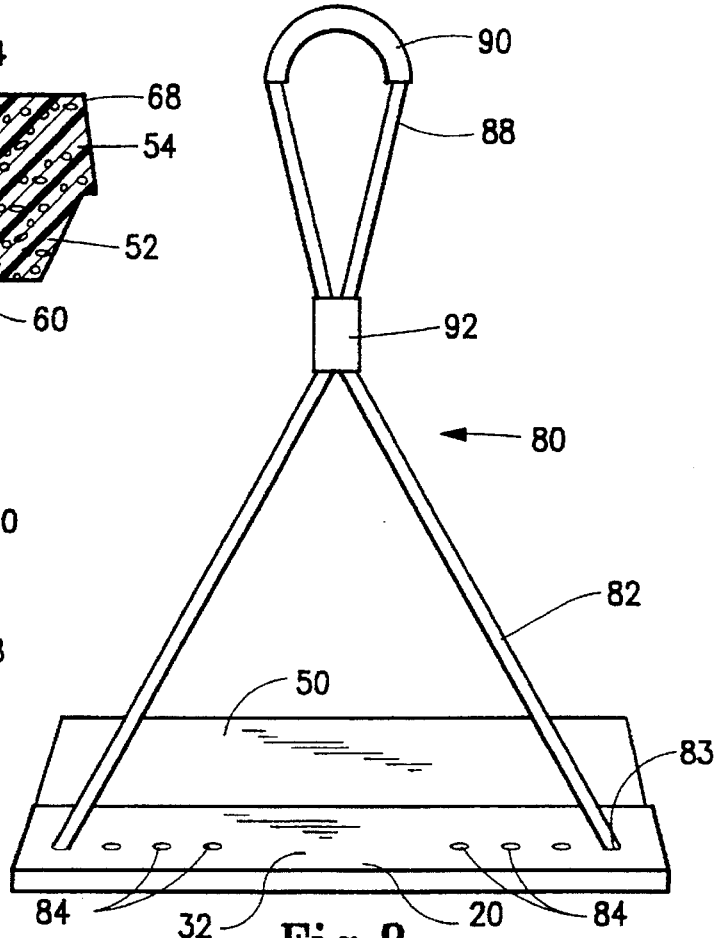
FIG. 8 is a side view in elevation showing the exercise apparatus of FIGS. 1–2 with an optional elastic cord element.
Figure 9:
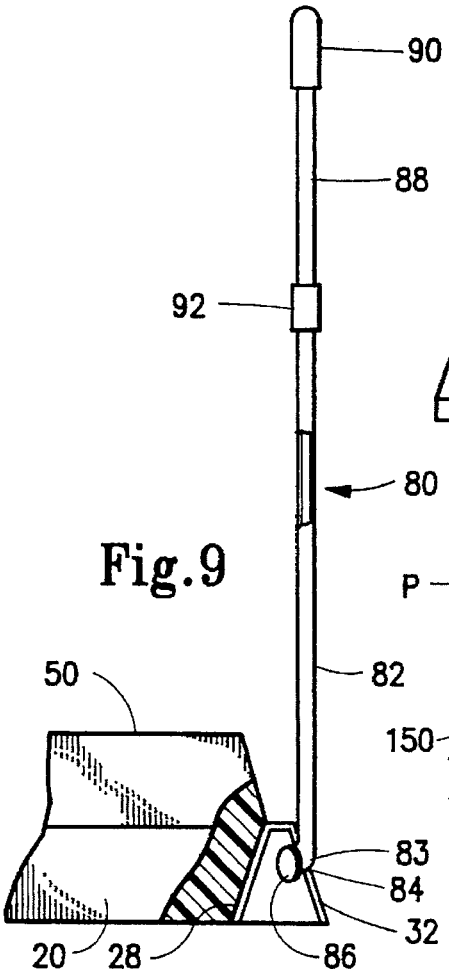
FIG. 9 is an end view in elevation and partially broken-away showing the optional cord of FIG. 8.

With reference now to FIGS. 8 and 9, it may be seen that exercise apparatus 10 may include a pair of optional resilient straps or cords such as cords 80 which are of sufficient length to be grasped by the hand of the user or, if desired, to extend over the shoulder's of the user. Cords 80 are mounted to base 20 on opposite sides thereof which are parallel to the elongate directed of the elongate cushion elements 50. With reference to FIGS. 8 and 9, it may be seen that each of cords 80 is preferably formed by a length of rubber tubing having opposite end portions 82 that terminate in ends 83 that define proximal ends for cord 80 that are secured in spaced-apart relation to one another to base member 20. As is best seen in FIG. 8, base member 20 includes a plurality of holes 84 through outer base wall 32, and end 83 may be selectively inserted through holes 84 and retained, for example, by a clip structure 86. Thus, each elastic cord 80 has a central loop portion 88 that forms a distal end for cord 80, and it is desirable that an enlarged grip 90 be disposed on central loop portion 88. Grip 90 is preferably a neoprene sleeve having an inner diameter that snugly receives cord 88 therethrough. Moreover, as is seen in FIGS. 8 and 9, an adjusting sleeve 92 encircles a mid-portion of cord 80 and is adjustable therealong so as to vary the angle between end portions 82 and thus varying the effective length of elastic cord 80. This adjustability not only allows variance in the effective length of the cord 80 but also, due to the changing angles, can affect the rebound performance of the elastic cord during exercise.

Figure 10:
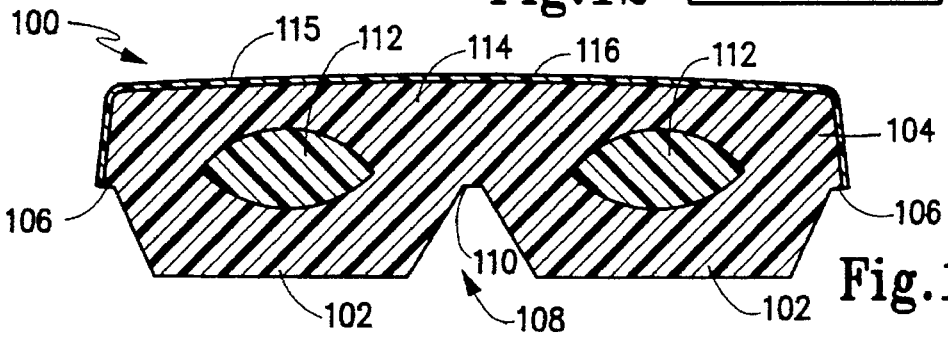
FIG. 10 is an end view in cross-section showing an alternative embodiment of the cushion member according to the present invention.

A first alternative embodiment of the cushion element for use with base member 20 is shown in FIG. 10. This figure shows several different structural features over cushion element 50. In FIG. 10, then, cushion element 100 is a single, integral cushion element adapted to be received in both sockets 34 of base member 20. Here, cushion element 100 includes a pair of lower portions 102 and a single, integral upper portion 104 which is jointed to each of lower portions 102 at a juncture defined by shoulder 106. Lower portions 102 are separated by a channel 108 which is sized and positioned to receive rib structure 36 of base member 20. Channel 108 is inverted and has a bottom wall 110 that will rest on top rib wall 40 when lower portions 102 are received in sockets 34.

As is seen in FIG. 10, cushion element 100 is constructed of two different foam materials. The main body of cushion element 100 is constructed of the dense urethane foam similar to that described with respect to each cushion 50. However, a pair of pillow inserts 112 are molded internally of main body 114 and are constructed of a material different from main body 114 thereby to impart different performance characteristics to cushion element 100. It should be understood that inserts 112 could be either more or less resilient than the material forming main body 114. Alternatively, inserts 112 could be formed of the urethane material described above, while main body 114 could be a different material that is either more or less compressible and resilient. Furthermore, as is shown in FIG. 10, cushion element 100 is provided with a skin 115 which covers upper surface 116 thereof. Skin 115 is preferably neoprene, latex or other similar materials, and is laminated directly onto upper portion 104, as is known in the art.

Figure 11:
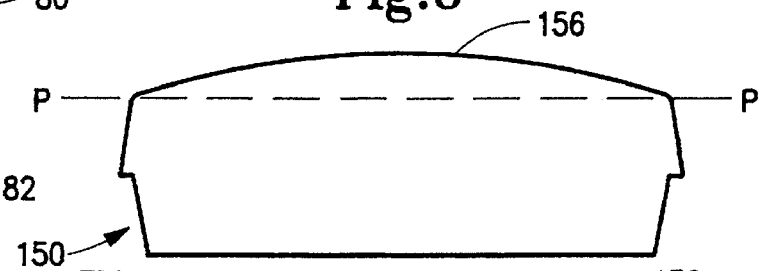
FIG. 11 is a side view in elevation of yet another alternative embodiment of the cushion element according to the present invention.
Figure 12:
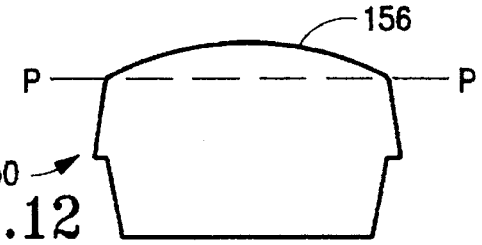
FIG. 12 is an end view in elevation of the cushion element shown in FIG. 11.

Yet another alternative embodiment of cushion elements 50 are shown in FIGS. 11 and 12. Here, cushion element 150 is constructed similarly to cushion element 50 but has an upper surface that is crowned both longitudinally and transversely with respect to a plane "P" that is parallel to the support surface when cushion elements 150 are received in base member 20. Thus, as is shown in FIG. 11, top surface 156 is arcuate along a radius of curvature that is larger in the longitudinal direction than the radius of curvature in the transverse direction, as is shown in FIG. 12.

Figure 13:
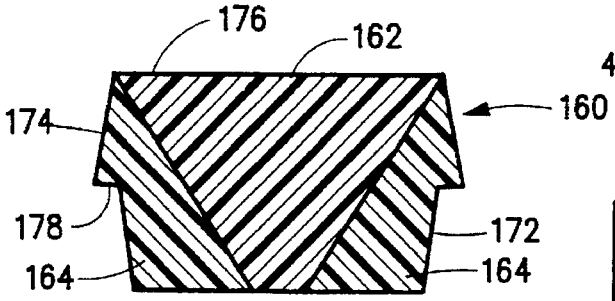
FIG. 13 is an end view in cross-section showing another alternative embodiment of a cushion element according to the present invention.

FIG. 13 shows still a further alternative embodiment of a cushion element which is useable with base member 20. Here, cushion element 160 is shown in cross-section to be molded from two different materials. Here, a central trapezoidal portion 162 is laminated with a pair of elongate side portions 164 formed of a different material than trapezoidal portion 162. The resulting appearance, however, is substantially the same as cushion element 50 so that cushion element 160 has a lower portion 172 which is adapted to matably engage with sockets 34 and an upper portion 174 terminating in an upper surface 176 that is engaged by the feet of the user. Here again, shoulder 178 that is provided to rest on rim portions 30 and 40.

Figure 14:
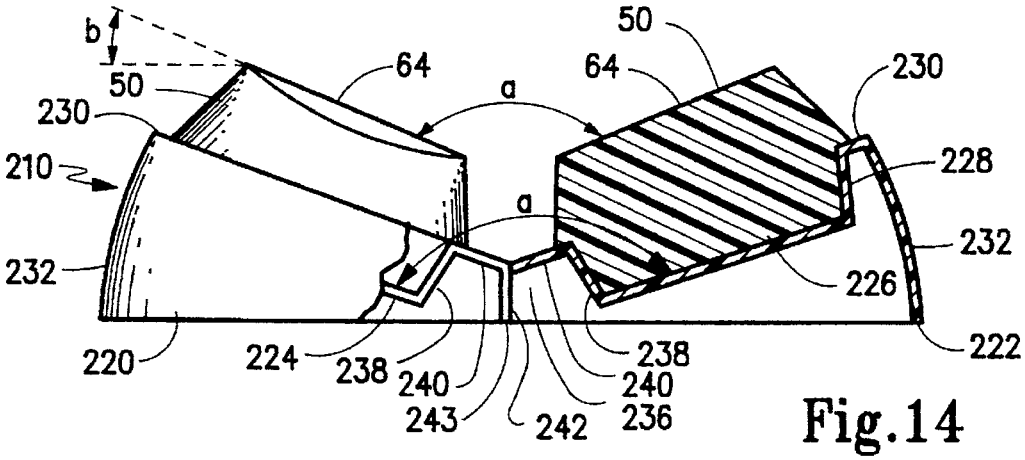
FIG. 14 is an end view in elevation, partially broken-away, showing an alternative embodiment of the base member according to the present invention.

An alternative embodiment of base member 20 is shown in FIG. 14. Here, base member 220 has a bottom 222 that is adapted to engage the flat support surface 12. A pair of bottom panels 224 and 226 are oriented at a large obtuse angle "a" which is preferable at least 140°. Base member 220 includes an inner sidewall 228 and an outer sidewall 232 joined to one another by an upper rim wall 230 similar to that described with respect to base member 20. Here, however, upstanding outer wall 232 has a greater vertical dimension than inner wall 228 so that bottom panels 224, 226 are each oriented at the above described angle of at least 140° with respect to one another. A rib structure 236 extends longitudinally in base member 220, in a manner similar to rib structure 36. Here, however, rib structure 236 includes a pair of rib walls 238 which are connected together by a pair of upper rib walls 240 that are further supported at a juncture thereof by a downwardly depending web 242 which terminates in an edge 243 that is coextensive with bottom 222. With this construction, it may be seen that upper surfaces 64 are oriented at a similar angle "a" as are panel sections 224, 226 with surfaces 64 being oriented with respect to the flat support surface at one-half the supplementary angle to "a". Accordingly, each of surfaces 64 is oriented at an angle "b" with respect to the flat support surface that is 20° or less.

Figure 15:
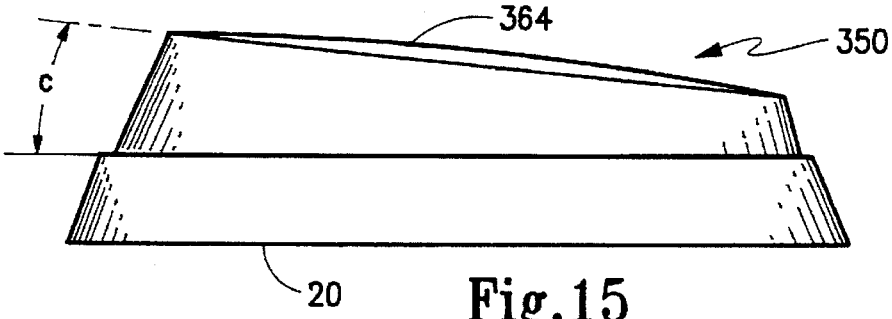
FIG. 15 is a side view in elevation showing yet another embodiment of the cushion element according to the present invention.

With reference to FIG. 15, it may be seen that yet another alternative embodiment of the cushion element is provided. Here, cushion element 350 is nestably received in base member 20 and, as is shown in this figure, has an upper surface 364 that is formed at a longitudinal angle "c" which respect the horizontal support surface. Here again, angle "c" is preferably 20° or less so that surface 364 presents an incline to the feet and legs of the user during use.

Figure 16:
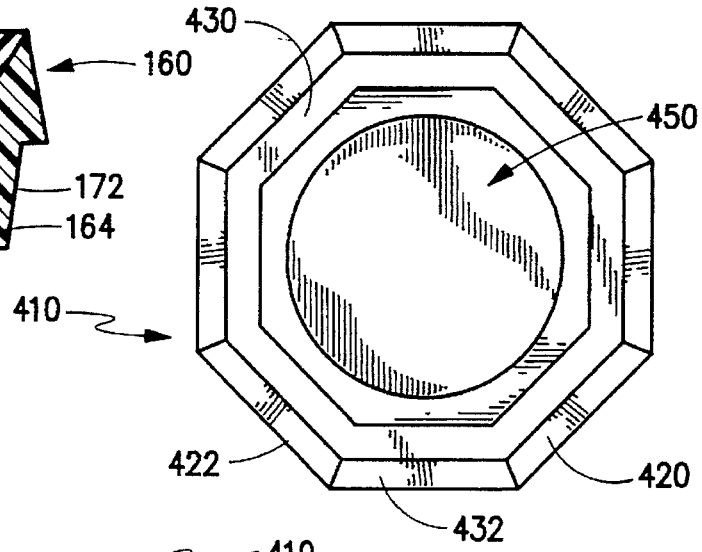
FIG. 16 is a top plan view showing a second exemplary embodiment of the present invention.
Figure 17:
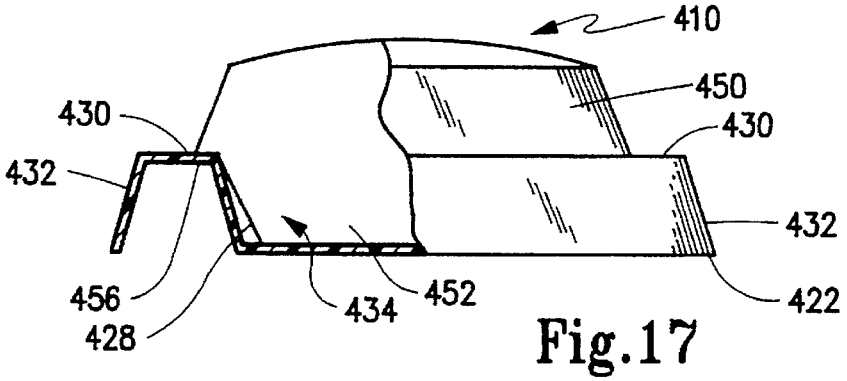
FIG. 17 is a side view in elevation and partial cross-section of the exercise apparatus shown in FIG. 16.

A final exemplary embodiment of the present invention is shown in FIGS. 16 and 17. Here, it may be appreciated that exercise apparatus 410 may take a variety of configurations such as the octagonal configuration shown in these figures. Preferably, the shape of the exercise apparatus, and, in particular the shape of the corresponding cushion element(s) is that of a polygon, such as a square, a rectangle, a hexagon or an octagon. In FIGS. 16 and 17, it may be seen that base 420 has an octagonal bottom 422 formed by the lower edge of an outer upstanding wall 432 which is joined by an inner upstanding wall 428 by means of an upper rim wall 430. Inner wall 428 defines a single socket 434 which receives a lower portion 452 of cushion element 450 in a close fitting, nested relation. Upper portion 454 of cushion element 450 joins lower portion 452 at a shoulder 456 that projects laterally outwardly to rest on upper rim wall 430 to provide stability, and suitable recesses and key structures may be provided on lower portion 452 and inner wall 428, as desired.

From the foregoing, it should be appreciated that the exercise apparatus according to the present invention may be constructed in a variety of manners. For example, the base member may have a single socket or multiple sockets, and may be configured in a variety of geometric shapes. Either a single cushion element may be received in the abase member or, more preferably, a pair of interchangeable yet independent cushion elements may be received in the base member and supported thereby. These cushion elements may be constructed of different compressible, resilient materials, and one or more such materials may be used in the construction to give different performance characteristics. Indeed, a user may acquire several different pairs of cushion elements for use with a common base with these pairs of cushion elements having different performance characteristics so that the person may achieve different exercise regimens.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. An exercise apparatus adapted to be supported on a flat support surface for use in exercising a user's legs, comprising:

(a) a base member including a bottom for engaging the flat support surface and having an upwardly opening socket defined by a bottom panel and an upright surrounding socket sidewall; and (b) a cushion element constructed of a resilient compressible material and including a lower portion sized and adapted to be nestably received in said socket thereby to retain said cushion element in a mounted state with respect to said base member and an upper portion forming a domical structure that projects above said base member when said cushion element is in the mounted state, said domical structure having a top surface operative to engage a foot of a user during use.

2. An exercise apparatus according to claim 1 wherein said base member has a pair of upwardly opening sockets, said cushion element including a pair of lower portions sized and positioned to respectively engage both said sockets, said cushion element including a unitary upper portion forming a main body thereof.

3. An exercise apparatus according to claim 1 wherein said base member includes an upper rim portion adjacent to said socket, said cushion element including a surrounding shoulder formed at a juncture of said lower and upper portions, said shoulder operative to engage said upper rim portion when said cushion element is in the mounted state.

4. An exercise apparatus according to claim 1 wherein said socket sidewall is upwardly divergent.

5. An exercise apparatus according to claim 1 wherein said upper portion of said cushion element has a periphery shaped as a polygon.

6. An exercise apparatus according to claim 5 wherein said polygon is selected from a group consisting of: squares, rectangles, hexagons and octagons.

7. An exercise apparatus according to claim 1 wherein said cushion element is formed of at least two different resilient compressible materials.

8. An exercise apparatus according to claim 7 wherein one of said resilient compressible materials is constructed as an insert which is completely engulfed by another of said resilient compressible materials.

9. An exercise apparatus according to claim 1 wherein said cushion element includes a skin forming the top surface thereof, said skin constructed of a neoprene.

10. An exercise apparatus according to claim 1 wherein the top surface of said cushion element is configured to be oriented at an acute angle of no more that twenty degrees with respect to the flat support surface when said cushion element is in the mounted state and said base is supported on the flat support surface.

11. An exercise apparatus according to claim 1 wherein said base member has a pair of upwardly opening sockets, each defined by a bottom panel and an upright surrounding socket sidewall, and including a pair of independent cushion elements each constructed of a resilient compressible material and each including a lower portion sized and adapted to be nestably received in a respective said socket thereby to retain said cushion element in a mounted state with respect to said base member, each said cushion element including an upper portion forming a domical structure that projects above said base member when the respective said cushion element is in the mounted state, said domical structures having respective top surfaces operative to engage a respective foot of a user during use.

12. An exercise apparatus adapted to be supported on a flat support surface for use in exercising a user's legs, comprising:

(a) a base member including a bottom for engaging the flat support surface and having an upwardly opening socket including an upright surrounding socket sidewall;

(b) a cushion element constructed of a resilient compressible material and including a lower portion sized and adapted to be nestably received in said socket thereby to retain said cushion element in a mounted state with respect to said base member and an upper portion forming a domical structure that projects above said base member when said cushion element is in the mounted state, said domical structure having a top surface operative to engage a foot of a user during use; and (c) first and second elastic cords disposed on opposite sides of said base member each including proximal end portions secured thereto, said cords of sufficient length such that the user may grasp distal end portions thereof while standing on the top surface of said cushion element.

13. An exercise apparatus according to claim 12 wherein each of said elastic cords is formed as a loop having a pair of opposite ends fastened to said base member at spaced locations from one another to define the proximal end portion of the respective cord, each of said elastic cords having a central loop defining the distal end portion of the respective cord.

14. An exercise apparatus according to claim 13 including a retainer sleeve encircling a mid-portion of said cord, said sleeve being slideably adjustable therealong.

15. An exercise apparatus according to claim 13 including a plurality of mounting locations disposed on side base member for opposite ends of each of said cords.

16. An exercise apparatus according to claim 13 including an enlarged grip disposed on each of said loops.

17. An exercise apparatus adapted to be supported on a flat support surface for use in exercising a user's legs, comprising:

(a) a base member operative to engage the flat support surface and including a bottom panel, an upstanding inner wall surrounding a cavity, an upstanding outer wall extending around a perimeter of said base member and an upstanding rib disposed on said bottom panel and positioned so as to separate said bottom panel into first and second bottom panel sections and to separate the cavity into juxtaposed upwardly opening first and second sockets;

(b) first and second cushion elements each constructed of a resilient compressible material and each including a lower portion sized and adapted to be nestably received interchangeably in said first and second sockets thereby to retain said first and second cushion elements in a mounted state with respect to said base member and an upper portion forming a domical structure that projects above said base member when said cushion element is in the mounted state, said domical structures each having a top surface operative to engage a respective foot of a user during use.

18. An exercise apparatus according to claim 17 wherein each of said first and second sockets and each of said first and second cushion elements are elongate in configuration.

19. An exercise apparatus according to claim 17 wherein each of said first and second bottom panel sections has a hole formed therethrough.

20. An exercise apparatus according to claim 17 wherein said first and second bottom panel sections are oriented at an obtuse angle of at least 140 degrees with respect to one another with the top surfaces of said first and second cushion elements being similarly oriented with respect to one another.

21. An exercise apparatus according to claim 17 wherein said inner and outer walls are joined to one another by a top wall that defines a rim for the cavity, said inner and outer walls being downwardly divergent from one another, said rib having an upper rib wall that is coextensive with said top wall, each said first and second cushion element including a surrounding shoulder formed at a juncture of the lower and upper portions thereof, each said shoulder operative to engage said top wall and said upper rib wall when the respective said cushion element is in the mounted state.

22. An exercise apparatus according to claim 21 wherein said rib is constructed as an inverted channel including opposed rib sidewalls joined by said upper rib wall.

23. An exercise apparatus according to claim 22 wherein said base member is constructed as an integral one-piece molded shell.

24. An exercise apparatus according to claim 17 wherein each of said sockets has a surrounding sidewall, each said sidewall having a plurality of recesses formed therein, said lower portion of each said cushion element including a plurality of key structures sized and oriented to engage the recesses when said cushion element is in the mounted state.

25. An exercise apparatus according to claim 17 wherein each said cushion element is formed of at least two different resilient compressible materials.

26. An exercise apparatus according to claim 17 wherein the top surface of each said cushion element is configured to be oriented at an acute angle of no more that twenty degrees with respect to the flat support surface when said cushion element is in the mounted state and said base is supported on the flat support surface.

27. An exercise apparatus according to claim 17 including first and second elastic cords disposed on opposite sides of said base member and each including proximal end portions secured thereto, said cords of sufficient length such that the user may grasp distal end portions thereof while standing on the top surface of said cushion element.

28. An exercise apparatus adapted to be supported on a flat support surface for use in exercising a user's legs, comprising:

(a) a base member including a bottom for engaging the flat support surface and having an upwardly opening socket including an upright surrounding socket sidewall having a recess formed therein; and (b) a cushion element constructed of a resilient compressible material and including a lower portion including a key structure which is sized and oriented to nestably engage the recess thereby to retain said cushion element in a mounted state with respect to said base member and an upper portion forming a domical structure that projects above said base member when said cushion element is in the mounted state, said domical structure having a top surface operative to engage a foot of a user during use.

29. An exercise apparatus adapted to be supported on a flat support surface for use in exercising a user's legs, comprising:

(a) a base member including a bottom for engaging the flat support surface, an upwardly divergent inner base wall and an upwardly convergent outer base wall, said base member including an upwardly opening socket with a surrounding socket sidewall that is defined by said inner base wall; and (b) a cushion element constructed of a resilient compressible material and including a lower portion sized and adapted to be nestably received in said socket thereby to retain said cushion element in a mounted state with respect to said base member and an upper portion forming a domical structure that projects above said base member when said cushion element is in the mounted state, said domical structure having a top surface operative to engage a foot of a user during use.

* * * * *